US008189847B2

(12) United States Patent
Huang

(10) Patent No.: US 8,189,847 B2
(45) Date of Patent: May 29, 2012

(54) DUAL-FREQUENCY COAXIAL EARPHONES WITH SHARED MAGNET

(75) Inventor: Fred Huang, Taoyuan (TW)

(73) Assignee: Jetvox Acoustic Corp., Taoyuan, Taoyuan County (TW)

( * ) Notice: Subject to any disclaimer, the term of this patent is extended or adjusted under 35 U.S.C. 154(b) by 533 days.

(21) Appl. No.: 12/379,390

(22) Filed: Feb. 20, 2009

(65) Prior Publication Data

US 2010/0046783 A1 Feb. 25, 2010

(30) Foreign Application Priority Data

Aug. 21, 2008 (TW) ..... 97215011 U

(51) Int. Cl.
*H04R 25/00* (2006.01)

(52) U.S. Cl. ..... 381/380; 381/186; 381/345; 381/346; 381/370; 381/335

(58) Field of Classification Search ..... 381/186, 381/335, 345–346, 370, 380
See application file for complete search history.

(56) References Cited

U.S. PATENT DOCUMENTS 4,965,836 A * 10/1990 Andre et al. ..... 381/370
7,391,863 B2 * 6/2008 Viduya et al. ..... 379/430
7,929,726 B1 * 4/2011 Jones ..... 381/431
2004/0047478 A1 * 3/2004 Combest ..... 381/182
2005/0286717 A1 * 12/2005 Viduya et al. ..... 379/430
2008/0240486 A1 * 10/2008 Garcia et al. ..... 381/380
2009/0279729 A1 * 11/2009 Huang ..... 381/345
2010/0092023 A1 * 4/2010 Bryant et al. ..... 381/397

FOREIGN PATENT DOCUMENTS

JP 3147185 * 12/2008
WO WO 2008-123667 * 10/2008

* cited by examiner

*Primary Examiner* — A. Sefer
(74) *Attorney, Agent, or Firm* — Bacon & Thomas, PLLC

(57) ABSTRACT

A dual-frequency coaxial earphone has a shared magnet, which is interposed between a top board of a outer yoke and an outer disk of a inner yoke, wherein the outer yoke and the inner yoke each has a different polarity. A low-frequency voice coil of a low-frequency speaker part extends axially into and between an annular wall of the outer yoke and the outer disk of the inner yoke. An inner sleeve of the inner yoke extends into a first central opening of the outer yoke. Therefore, a high frequency of the high-frequency speaker part can pass through the inner sleeve so as to energize a central diaphragm of the low-frequency speaker part and to form a same phase as, and to output frequency synchronously with, the low-frequency speaker part. As such, the problem of intermodulation of distortion for the high and low acoustic frequencies can be solved, and that dimension of the earphone can be minimized.

10 Claims, 6 Drawing Sheets

DUAL-FREQUENCY COAXIAL EARPHONES WITH SHARED MAGNET

BACKGROUND OF THE INVENTION

1. Field of the Invention

The present invention relates to an earphone, and more particularly, to a dual-frequency coaxial earphone with a shared magnet.

2. Description of Related Art

Referring to FIG. 1, a cross-sectional view illustrating a conventional earphone, the earphone 9 comprises a housing 90, a cord 91, a diaphragm 92, a permanent magnet 93, a voice coil 94, a pole piece 95, and a yoke 96.

As shown in FIG. 1, the cord 91, the diaphragm 92, the permanent magnet 93, the voice coil 94, the pole piece 95, and the yoke 96 are received in the housing 90, respectively, wherein the voice coil 94 is disposed on the diaphragm 92 and surrounds the permanent magnet 93, while maintains a gap, radially, with the pole piece 95. The permanent magnet 93 is interposed between the pole piece 95 and the yoke 96.

The cord 91 is electrically connected with the voice coil 94, so that when acoustic frequency signal is transmitted to the voice coil 94 via the cord 91, the voice coil 94 produces a magnetic field due to a magnetic effect. The magnetic field will then magnetically interact with the pole piece 95, making the diaphragm 92 vibrated and the acoustic frequency signal converted into and outputting an acoustic -frequency wave.

Conventionally, an acoustic frequency signal involves a high-frequency speaker part and a low-frequency speaker part. Therefore, vibration of the same diaphragm 92 produces, simultaneously, a high acoustic frequency wave and a low acoustic frequency wave. However, since the high- and low-frequency acoustic waves involve characteristics of different wavelengths and amplitudes, respectively, the same diaphragm 92 cannot distinguish clearly the characteristics from one another. As such, the conventional earphone results in a shortage on distortion of intermodulation for the high and low acoustic frequencies, and fails to produce a clear sound. To overcome the shortage, if a high-frequency speaker and a low-frequency speaker are arranged together in an earphone, a bulk size will make the earphone impractical.

SUMMARY OF THE INVENTION

The present invention is to provide a dual-frequency coaxial earphone with a shared magnet, comprising a housing, an outer yoke, a shared annular magnet, an inner yoke, a low-frequency speaker part, and a high-frequency speaker part.

The housing is provided, inside, with a receiving chamber. The outer yoke has a hat-like shape and is arranged inside the receiving chamber of the housing. The outer yoke includes a crown portion and a flange portion, where the flange portion surrounds the crown portion. The crown portion includes a top board and an annular wall, where the top board is provided with a first central opening.

According to the present invention, the shared annular magnet is arranged at interior of the top board of the outer yoke, such that the outer yoke and an external contacting surface of the shared annular magnet have the same polarity. The shared annular magnet includes a second central opening which is coaxial with the first central opening of the outer yoke.

The inner yoke has a flange-like shape, and includes an inner sleeve and an outer disk, where the outer disk surrounds the inner sleeve. The inner yoke is arranged, through the outer disk, on the shared annular magnet and located opposite to the outer yoke. Therefore, both the inner yoke and an internal contacting surface of the shared annular magnet have a same polarity. The outer disk has an outer diameter smaller than an inner diameter defined by an inner wall of the outer yoke, and that the inner sleeve has an outer diameter smaller than that of a diameter of the first central opening of the outer yoke. The inner sleeve extends into the second central opening of the shared annular magnet, and into the first central opening of the outer yoke. The inner sleeve is provided, at center, with a third central opening acting as an acoustic guide.

In the present invention, the low-frequency speaker part includes a low-frequency voice coil and a low-frequency diaphragm, wherein the low-frequency diaphragm includes a central diaphragm. The low-frequency voice coil is disposed on the low-frequency diaphragm, and extends axially into and between the annular wall of the outer yoke and the outer disk of the inner yoke, where the low-frequency voice coil, the annular wall, and the outer disk each maintains a clearance radially from one another. The low-frequency diaphragm is, circumferentially, disposed on the flange portion of the outer yoke.

The high-frequency speaker part includes a high-frequency voice coil and a high-frequency diaphragm, wherein the high-frequency voice coil is arranged on the high-frequency diaphragm and extends axially into and between the first central opening of the outer yoke and the inner sleeve of the inner yoke, and wherein the high-frequency voice coil, the first central opening, and the inner sleeve each maintains another clearance radially from one another, and periphery of the high-frequency diaphragm is disposed on the crown portion of the outer yoke.

The inner sleeve of the low-frequency speaker part is communicated with and between the high-frequency speaker part and the central diaphragm of the low-frequency speaker part.

Therefore, a high frequency of the high-frequency speaker part can pass through the inner sleeve so as to energize the central diaphragm of the low-frequency speaker part and to form a same phase as, and to output frequency synchronously with, the low-frequency speaker part. The high-frequency acoustic wave and the low-frequency acoustic wave can be separated from each other. As such, the problem of intermodulation of distortion for the high and low acoustic frequencies can be solved, and that dimension of the earphone can be minimized.

The low-frequency speaker part may include an acoustic cone, wherein the acoustic cone is fixed to the outer disk of the inner yoke, and is provided, at center, with an acoustic hole which is coaxially aligned, and communicated with the third central opening of the inner sleeve so as to distribute uniformly frequency of the high-frequency speaker part to surface of the central diaphragm of the low-frequency speaker part.

Further, the dual-frequency coaxial earphone, according to the present invention, may comprise a circuit board including a frequency divider which is provided for dividing a mixed acoustic input signal into a high-frequency output signal and a low-frequency output signal which are used, respectively, by the high-frequency voice coil and the low-frequency voice coil.

The outer yoke may further include a plurality of vents provided around the flange portion, and through the vents outside air can be introduced into an enclosing space formed by the outer yoke, the low-frequency speaker part, and the high-frequency speaker part so as to maintain pressure balance inside and outside of the enclosing space.

The low-frequency diaphragm may include an inner ring and an outer ring, wherein the low-frequency voice coil is disposed in the inner ring, and the outer ring is disposed on the flange portion of the outer yoke.

Still further, the high-frequency diaphragm may include an inner ring and an outer ring, wherein the high-frequency voice coil is disposed in the inner ring, and the outer ring on the crown portion of the outer yoke. The low-frequency voice coil may include an anchoring ring, and that the high-frequency speaker part include another anchoring ring, wherein the anchoring ring is disposed on the flange portion of the outer yoke so as to secure the low-frequency diaphragm. The other anchoring ring is disposed on the crown portion of the outer yoke so as to secure the high-frequency diaphragm.

According to the present invention, the housing may include an earplug, or be provided with a headset. Further, the housing may be applied to earphones of various shapes or dimensions. The housing may include a case and a front cover which are wrapped up together, or are integrally made in one piece.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
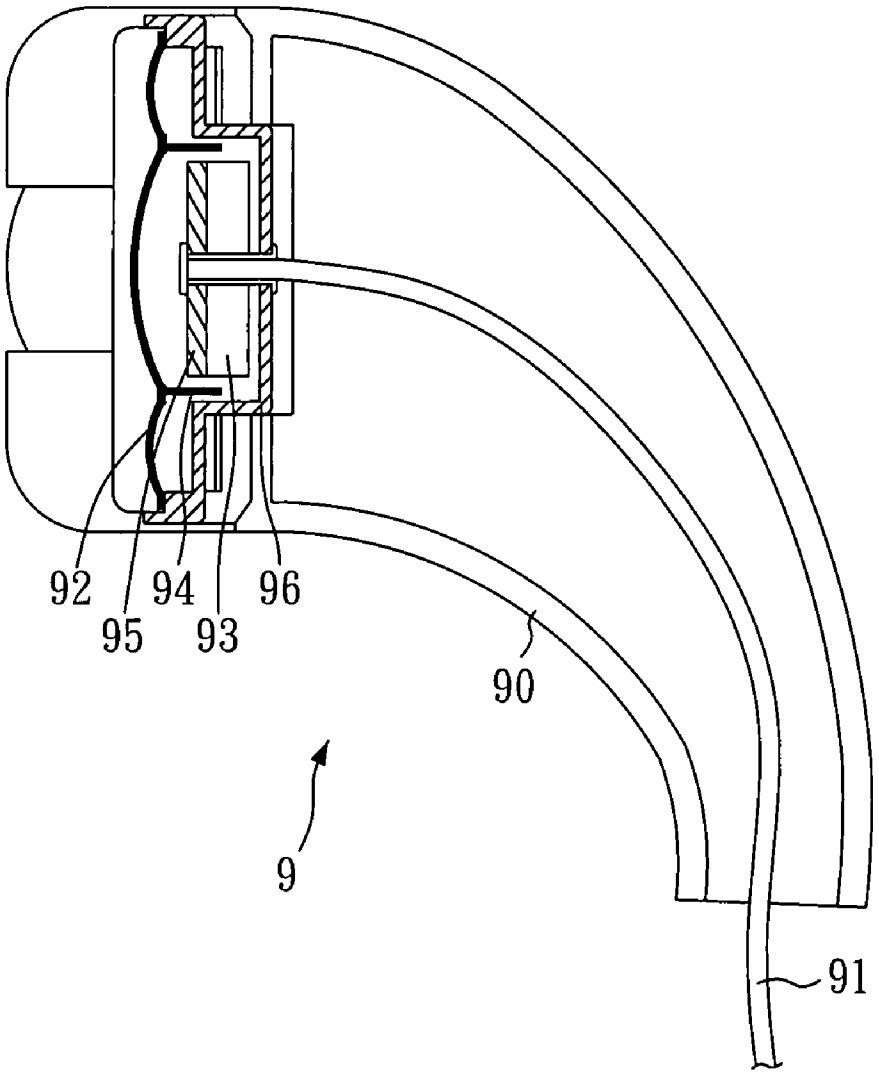
FIG. 1 (PRIOR ART)
FIG. 1 is a cross-sectional view illustrating a conventional earphone.
Figure 2:
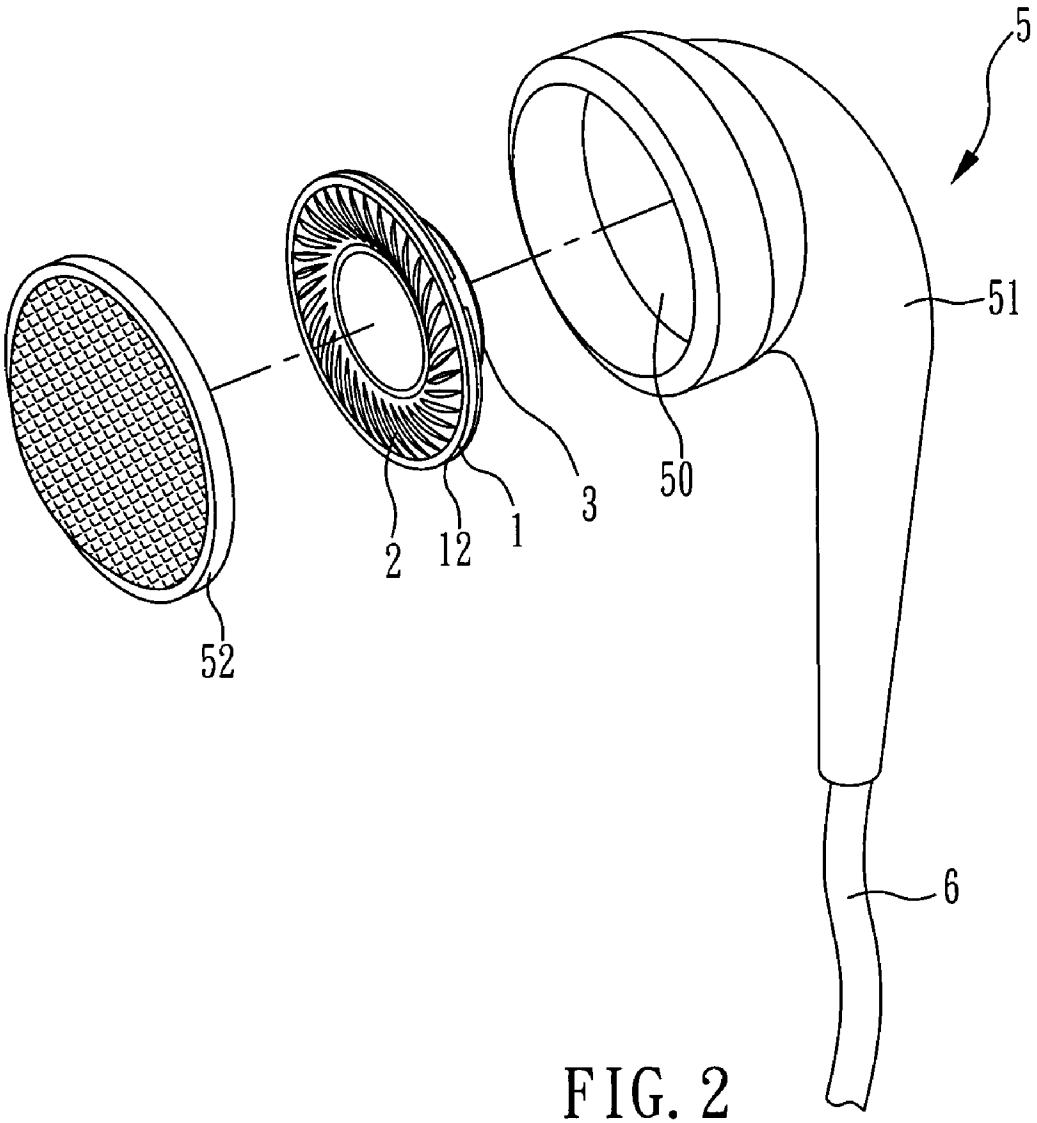
FIG. 2 is a perspective view illustrating an earphone according to a first embodiment of the present invention.
Figure 3:
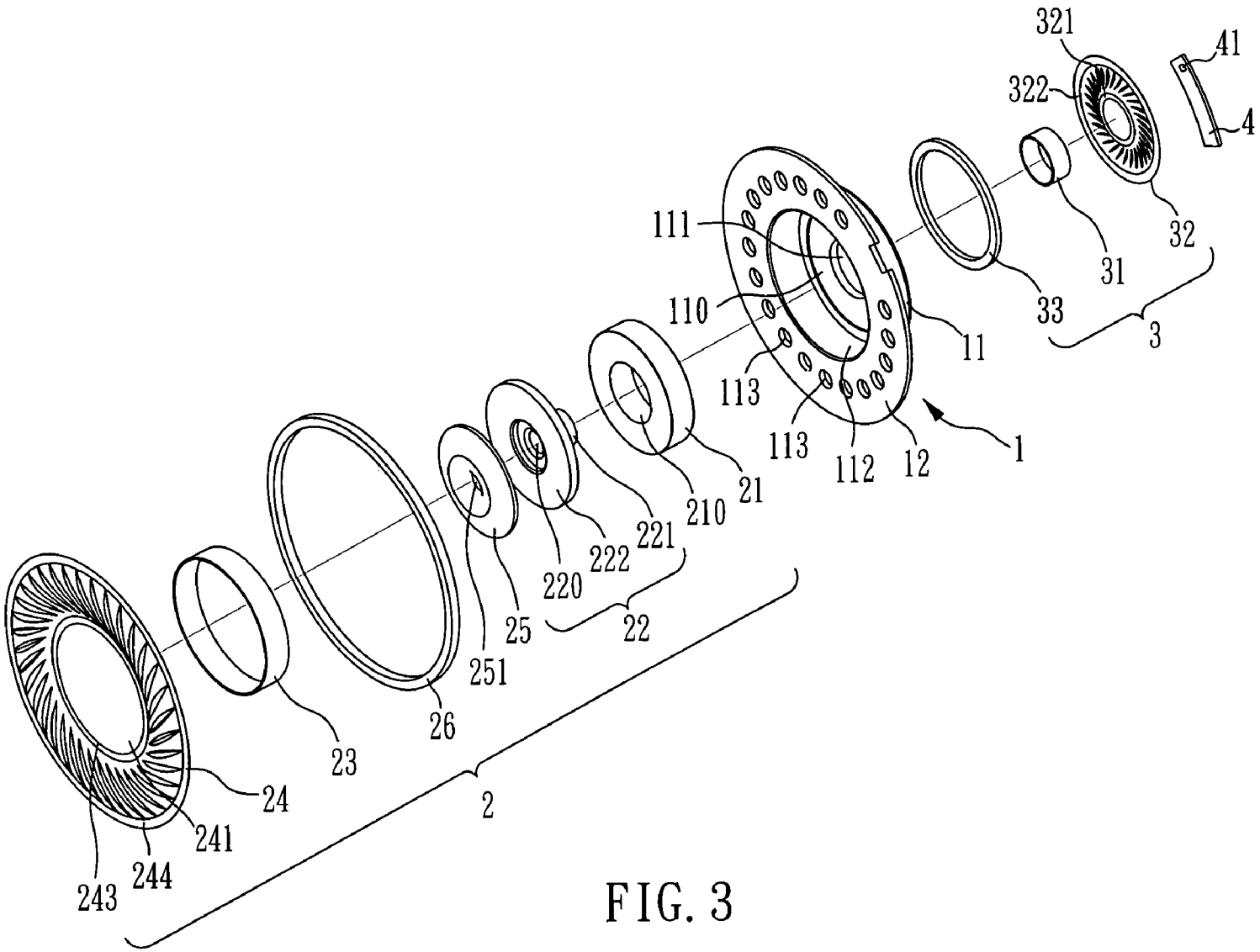
FIG. 3 is an exploded view illustrating the earphone according to the first embodiment of the present invention.

Referring to FIG. 2, a perspective view illustrating an earphone according to a first embodiment of the present invention, and to FIG. 3, an exploded view illustrating the earphone, a dual-frequency coaxial earphone comprises a housing 5, an outer yoke 1, a low-frequency speaker part 2, a shared annular magnet 21, an inner yoke 22, a high-frequency speaker part 3, and a circuit board 4. The housing 5 includes a case 51 and a front cover 52, and is provided, inside, with a receiving chamber 50.

As shown in FIG. 3, the circuit board 4 includes a frequency divider 41 which is provided for dividing a mixed acoustic input signal into a high-frequency output signal and a low-frequency output signal which are used, respectively, by a high-frequency voice coil 31 and a low-frequency voice coil 23.

Further, as shown in FIGS. 2 and 3, the outer yoke 1, the low-frequency speaker part 2, and the high-frequency speaker part 3 are all together received in the housing 5. A cord 6 is electrically connected with the frequency divider 41 so as to provide the frequency divider 41 a mixed acoustic input signal.

Figure 4:
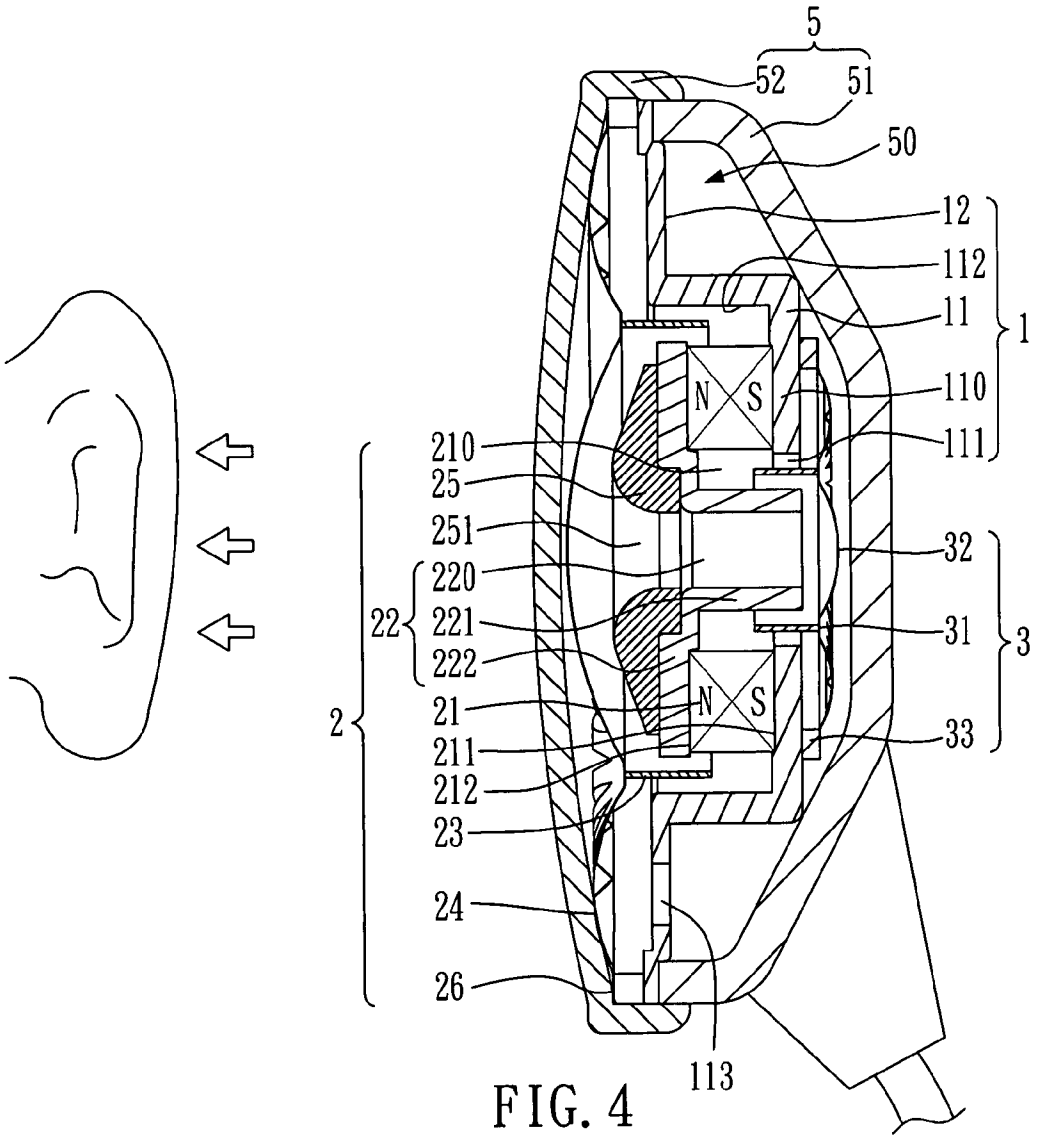
FIG. 4 is a cross-sectional view illustrating the earphone according to the first embodiment of the present invention.

Now referring to FIG. 4, a cross-sectional view illustrating the earphone according to the first embodiment of the present invention, and as well to FIGS. 2 and 3, the outer yoke 1 has a hat-like shape and is arranged inside the receiving chamber 50 of the housing 5. The outer yoke 1 includes a crown portion 11 and a flange portion 12, where the flange portion 12 surrounds the crown portion 11. The outer yoke 1 is disposed inside the housing 5 with the help of the periphery of the flange portion 12. The crown portion 11 includes a top board 110 and an annular wall 112, where the top board 110 is provided with a first central opening 111.

The outer yoke 1 further includes a plurality of vents 113 provided around the flange portion 12, and through the vents 113 outside air can be introduced into an enclosing space formed by the outer yoke 1, the low-frequency speaker part 2, and the high-frequency speaker part 3 so as to maintain a balance of pressure inside and outside of the enclosing space.

As shown in FIG. 4, the shared annular magnet 21 is, with its external contacting surface 211, tightly adhered to interior of the top board 110 of the outer yoke 1, such that the outer yoke 1 is tightly fixed to the shared annular magnet 21 at its external contacting surface 211, and both the outer yoke 1 and the external contacting surface 211 of the shared annular magnet 21 have the same polarity, i.e. pole S shown in FIG. 4. The shared annular magnet 21 includes a second central opening 210 which is coaxial with the first central opening 111 of the outer yoke 1.

As shown in FIGS. 3 and 4, the inner yoke 22 has a flange-like shape, and includes an inner sleeve 221 and an outer disk 222, where the outer disk 222 surrounds the inner sleeve 221. The outer disk 222 is tightly adhered to an internal contacting surface 212 of the shared annular magnet 21 opposite to the outer yoke 1. Namely, the shared annular magnet 21 is interposed, axially, between the outer disk 222 of the inner yoke 22 and the top board 110 of the outer yoke 1, such that the inner yoke 22 tightly contacts the internal contacting surface 212 of the shared annular magnet 21 and has a polarity, such as pole N shown in FIG. 4, same as that of the shared annular magnet 21. Obviously, the outer yoke 1 and the inner yoke 22 have different polarities.

The outer disk 222 has an outer diameter smaller than an inner diameter defined by an inner wall of the outer yoke 1, and that the inner sleeve 221 has an outer diameter smaller than that of a diameter of the first central opening 111 of the outer yoke 1. The inner sleeve 221 extends into the second central opening 210 of the shared annular magnet 21, and into the first central opening 111 of the outer yoke 1. The inner sleeve 221 is provided, at center, with a third central opening 220 acting as an acoustic guide.

The low-frequency speaker part 2 includes a low-frequency voice coil 23, a low-frequency diaphragm 24, an acoustic cone 25, and an anchoring ring 26, where the low-frequency diaphragm 24 includes a central diaphragm 241. The low-frequency voice coil 23 is disposed on the low-frequency diaphragm 24, and extends axially into and between the annular wall 112 of the outer yoke 1 and the outer disk 222 of the inner yoke 22, where the low-frequency voice coil 23, the annular wall 112, and the outer disk 222 each maintains a clearance radially from one another.

As shown in FIGS. 3 and 4, the low-frequency diaphragm 24 includes an inner ring 243 and an outer ring 244, wherein the low-frequency voice coil 23 is disposed in the inner ring 243, and the outer ring 244 is disposed on the flange portion 12 of the outer yoke 1.

The low-frequency diaphragm 24 is, circumferentially, disposed on the flange portion 12 of the outer yoke 1, and the anchoring ring 26 is attached to the flange portion 12 so as to fix the low-frequency diaphragm 24.

The acoustic cone 25 is fixed to the outer disk 222 of the inner yoke 22, and is provided, at center, with an acoustic hole 251 which is coaxially aligned, and communicated with the third central opening 220 of the inner sleeve 221 so as to distribute uniformly frequency of the high-frequency speaker part 3 to surface of the central diaphragm 241 of the low-frequency speaker part 2.

In the present invention, the outer yoke 1 acts as pole S of the shared annular magnet 21, while the inner yoke 22 as pole N. When low-frequency signals are transmitted to the low-frequency voice coil 23, a magnetic field so induced will be interacted with the magnetic field at poles S-N located between the annular wall 112 of the outer yoke 1 and the outer disk 222 of the inner yoke 22, and through vibration of the low-frequency diaphragm 24 acoustic wave can be spread out.

The high-frequency speaker part 3 includes a high-frequency voice coil 31 and a high-frequency diaphragm 32, wherein the high-frequency voice coil 31 is arranged on the high-frequency diaphragm 32 and extends axially into and between the first central opening 111 of the outer yoke 1 and the inner sleeve 221 of the inner yoke 22, and wherein the high-frequency voice coil 23, the first opening 111, and the inner sleeve 221 each maintains another clearance radially from one another, and periphery of the high-frequency diaphragm 32 is disposed on the crown portion 11 of the outer yoke 1.

Referring to FIGS. 3 and 4, the high-frequency diaphragm 34 includes an inner ring 321 and an outer ring 322, wherein the high-frequency voice coil 31 is disposed in the inner ring 321, and the outer ring 322 on the crown portion 11 of the outer yoke 1. The high-frequency speaker part 3 further includes another anchoring ring 33, where the other anchoring ring 33 is disposed on the crown portion 11 of the outer yoke 1 so as to secure the high-frequency diaphragm 32.

In the present invention, when high-frequency signals are transmitted to the high-frequency voice coil 31, a magnetic field so induced will be interacted with the magnetic field at poles S-N located between the top board 110 of the outer yoke 1 and the inner sleeve 221 of the inner yoke 22, and through vibration of the high-frequency diaphragm 32 acoustic wave can be spread out.

As shown in FIGS. 3 and 4, since the inner sleeve 221 of the low-frequency speaker part 2 is communicated with and between the high-frequency speaker part 3 and the central diaphragm 241 of the low-frequency speaker part 2, a high-frequency of the high-frequency speaker part 3 can pass through the inner sleeve 221 so as to energize the central diaphragm 241 of the low-frequency speaker part 2 and to form a same phase as, and to output frequency synchronously with, the low-frequency speaker part 2.

In the present invention, there are provided with the high-frequency speaker part 3 and the low-frequency speaker part 2, the high-frequency acoustic wave and the low-frequency acoustic wave can be separated from each other. As such, the problem of intermodulation of distortion for the high- and low-acoustic frequencies can be solved. In addition, in accompanying with a structural design on the coaxial earphone according to the present invention, dimension of the earphone can be minimized.

Figure 5:
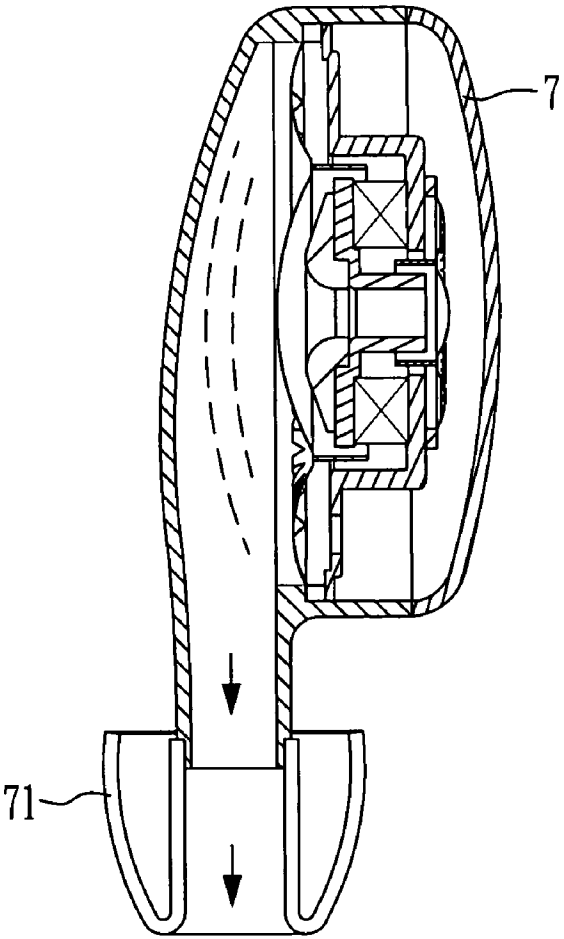
FIG. 5 is a cross-sectional view illustrating an earphone according to a second embodiment of the present invention.

Now referring to FIG. 5, a cross-sectional view illustrating an earphone according to a second embodiment of the present invention, the second embodiment has a structure similar to that of the first embodiment, except that a housing thereof falls in an earplug-type housing 7, so that an earplug 71 is included. The earplug 71 extends along the earplug-type housing 7 radially.

Figure 7:
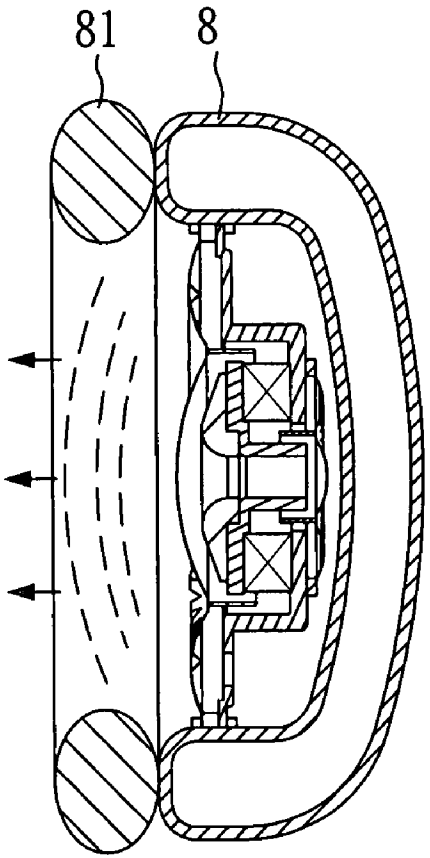
FIG. 7 is a cross-sectional view illustrating the earphone according to the third embodiment of the present invention.
Figure 6:
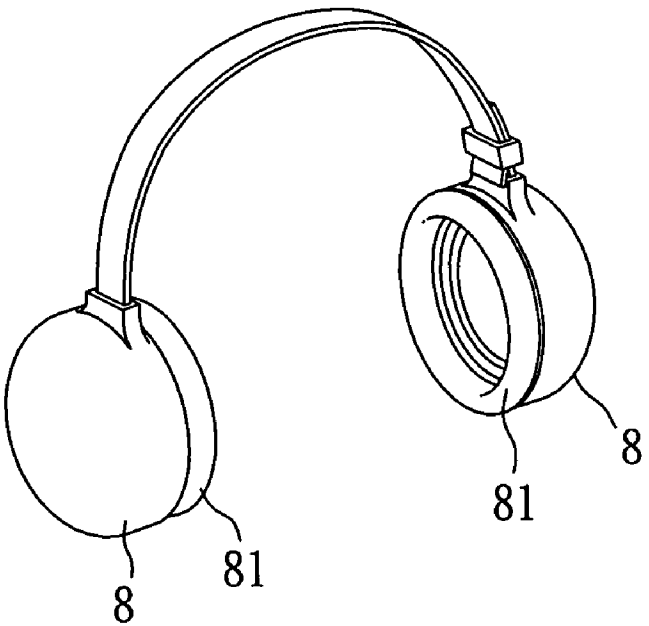
FIG. 6 is a perspective view illustrating an earphone according to a third embodiment of the present invention.

Further, referring to FIGS. 6 and 7, a perspective view and a cross-sectional view illustrating an earphone according to a third embodiment of the present invention, the third embodiment is similar, in structure, to the first embodiment, except that a housing thereof falls in a headset-type housing 8, so that a headset 81 is included. The headset 81 extends along the headset-type housing 8 axially.

Although the present invention has been explained in relation to its preferred embodiments, it is to be understood that many other possible modifications and variations can be made without departing from the scope of the invention as hereinafter claimed.

What is claimed is:

1. A dual-frequency coaxial earphone with a shared magnet, comprising:

a housing, being provided, inside, with a receiving chamber;

an outer yoke, having a hat-like shape and being arranged inside the receiving chamber of the housing, and including a crown portion and a flange portion, wherein the flange portion surrounds the crown portion, and the crown portion includes a top board and an annular wall, and wherein the top board is provided with a first central opening;

a shared annular magnet, being arranged at interior of the top board of the outer yoke, and including a second central opening which is coaxial with the first central opening of the outer yoke;

an inner yoke, having a flange-like shape, and including an inner sleeve and an outer disk, wherein the outer disk surrounds the inner sleeve, and, through the outer disk, the inner yoke is arranged on the shared annular magnet and located opposite to the outer yoke, and wherein the outer disk has an outer diameter smaller than an inner diameter defined by an inner wall of the outer yoke, and the inner sleeve has an outer diameter smaller than that of a diameter of the first central opening of the outer yoke, and the inner sleeve extends into the second central opening of the shared annular magnet, and into the first central opening of the outer yoke, and wherein the inner sleeve is provided, at center, with a third central opening;

a low-frequency speaker part, including a low-frequency voice coil and a low-frequency diaphragm, wherein the low-frequency voice coil is disposed on the low-frequency diaphragm, and extends axially into and between the annular wall of the outer yoke and the outer disk of the inner yoke, and wherein the low-frequency voice coil, the annular wall, and the outer disk each maintains a clearance radially from one another, and wherein the low-frequency diaphragm is, circumferentially, disposed on the flange portion of the outer yoke; and a high-frequency speaker part, including a high-frequency voice coil and a high-frequency diaphragm, wherein the high-frequency voice coil is arranged on the high-frequency diaphragm and extends axially into and between the first central opening of the outer yoke and the inner sleeve of the inner yoke, and wherein the high-frequency voice coil, the first opening, and the inner sleeve each maintains another clearance radially from one another, and periphery of the high-frequency diaphragm is disposed on the crown portion of the outer yoke.

2. The dual-frequency coaxial earphone with a shared magnet as claimed in claim 1, wherein the low-frequency speaker part further includes an acoustic cone, and the acoustic cone is fixed to the outer disk of the inner yoke, and is provided, at center, with an acoustic hole which is coaxially aligned, and communicated with the third central opening of the inner sleeve.

3. The dual-frequency coaxial earphone with a shared magnet as claimed in claim 1, further comprising a circuit board including a frequency divider.

4. The dual-frequency coaxial earphone with a shared magnet as claimed in claim 1, wherein the outer yoke further includes a plurality of vents provided around the flange portion of the outer yoke.

5. The dual-frequency coaxial earphone with a shared magnet as claimed in claim 1, wherein the low-frequency diaphragm includes an inner ring and an outer ring, and the low-frequency voice coil is disposed in the inner ring, and the outer ring on the flange portion of the outer yoke.

6. The dual-frequency coaxial earphone with a shared magnet as claimed in claim 1, wherein the high-frequency diaphragm includes an inner ring and an outer ring, and the high-frequency voice coil is disposed in the inner ring, and the outer ring on the crown portion of the outer yoke.

7. The dual-frequency coaxial earphone with a shared magnet as claimed in claim 1, wherein the low-frequency voice coil further includes an anchoring ring, and the high-frequency speaker part further includes another anchoring ring, and wherein the anchoring ring is disposed on the flange portion of the outer yoke, and the other anchoring ring is disposed on the crown portion of the outer yoke.

8. The dual-frequency coaxial earphone with a shared magnet as claimed in claim 1, wherein the housing further includes an earplug, and the earplug extends along the housing radially.

9. The dual-frequency coaxial earphone with a shared magnet as claimed in claim 1, wherein the housing further includes a headset, and the headset extends along the housing axially.

10. The dual-frequency coaxial earphone with a shared magnet as claimed in claim 1, wherein the housing includes a case and a front cover.

* * * * *